US005176596A

United States Patent [19]

Ullman

[11] Patent Number: 5,176,596

[45] Date of Patent: Jan. 5, 1993

[54] EASY STORING THREE POSITION STEP STOOL

[75] Inventor: Myron Ullman, Canfield, Ohio

[73] Assignee: Boardman Molded Products, Youngstown, Ohio

[21] Appl. No.: 708,563

[22] Filed: May 31, 1991

[51] Int. Cl.[5] ..... A63B 5/00

[52] U.S. Cl. ..... 482/52; 108/19; 248/188.2; 248/346

[58] Field of Search ..... 108/11, 12, 19, 157; 248/188, 188.2, 346, 911; 297/438, 439; 211/207, 208; 482/51, 52

[56] References Cited

U.S. PATENT DOCUMENTS

| | | | |
|---|---|---|---|
| 1,635,183 | 7/1927 | Jeannotte . | |
| 1,933,602 | 7/1931 | Scherer . | |
| 2,592,912 | 4/1952 | Knipper . | |
| 3,035,671 | 5/1962 | Sicherman | 482/52 |
| 3,227,112 | 1/1966 | Wiseman . | |
| 3,643,608 | 2/1972 | DeCasaris | 108/157 |
| 3,743,283 | 7/1973 | Garrett | 482/52 |
| 4,106,418 | 8/1978 | Haaglund | 108/19 X |
| 4,549,767 | 10/1985 | Hampshire et al. | 297/439 |
| 4,624,341 | 11/1986 | Lee | 182/15 |
| 4,632,345 | 12/1986 | Barley | 248/171 |
| 4,648,593 | 3/1987 | Wilkinson | 482/52 |
| 4,832,355 | 5/1989 | Hung | 280/32.5 |
| 4,900,012 | 2/1990 | Fu | 482/52 |
| 5,037,084 | 8/1991 | Flor | 482/52 |
| 5,050,861 | 9/1991 | Thomas et al. | 482/52 |

FOREIGN PATENT DOCUMENTS

| | | | |
|---|---|---|---|
| 1350062 | 4/1974 | United Kingdom | 248/346 |

OTHER PUBLICATIONS

"The STEP Exerciser", L. L. Bean Catalogue, Spring, 1991.

"Step A Head" brochure.

*Primary Examiner*—Cary E. O'Connor
*Assistant Examiner*—L. Thomas
*Attorney, Agent, or Firm*—Browdy and Neimark

[57] ABSTRACT

Adjustable step stool for exercise purposes includes an inverted cup-shaped top section and a generally annular bottom section. The bottom section is provided with a series of vertical posts or ribs integrally molded therewith along its interior wall, these ribs having support ledges on both their tops and bottoms for alternatively supporting the bottom edge of the top section at different heights. When the top section is used alone, a lowest height step is provided. When the top section is supported in the bottom section in a first attitude of the bottom section, a step of intermediate height is provided. And when the bottom section is flapped over and the top section is supported in the bottom section in this inverted position, a step stool of third and greatest height is provided.

20 Claims, 1 Drawing Sheet

EASY STORING THREE POSITION STEP STOOL

FIELD OF THE INVENTION

The present invention relates to stepping stools and more particularly to a stepping stool which can be stored in a minimum of space, which is adjustable to three different heights and which can be used advantageously for exercise stepping activities.

BACKGROUND OF THE INVENTION

Adjustable stools are known in the prior art as can be seen for example by reference to U.S. Pat. No. 4,624,341. The benefits of stepping exercises have long been recognized in the prior art both for cardiovascular training as well as for diagnostic medical testing. Examples of equipment used for such stepping exercises are shown in U.S. Pat. Nos. 4,900,012; 4,648,593; 3,743,283; and 3,035,671. These devices, while effective, all tend to be rather large, bulky, complex and/or expensive pieces of equipment.

What is needed is a simple step stool which can be manufactured in large quantities at a low cost, which can take several different height forms for use by persons of different size and/or for more or less vigorous exercise, is inexpensive and which can be stored easily in a gymnasium or in other facilities used for storing aerobic equipment where it may be necessary that two dozen or so units be kept together at the same time.

Recently, a step device has been provided which achieves some of the above goals. The recent device is a molded four-inch step having two indentations in its bottom into which two small four-inch base elements can be inserted to increase the height of the device from four to eight inches. The base elements themselves also have indentations in their bottoms into which second small base elements can be inserted to increase the height from eight to twelve inches. This device has been advertised, and while it may have received some degree of commercial acceptability, it has a serious defect in that it is not easily stored. If the device is stored with all of the inserts in their inserted positions, the device takes up space of one full foot in height. If the device is stored with all the parts separated, there are at least five separate parts to keep track of and which can become lost.

What is still needed is a device which can be stored in a compact condition, smaller than the above mentioned device, and yet which can be used to create a step stool having a variety of different exercising heights.

SUMMARY OF THE INVENTION

It is therefore an object of the present invention to overcome and eliminate the problems and deficiencies of the prior art, such as those indicated above.

It is another object of the present invention to provide a stepping stool which can be stored in a minimum of space yet which is adjustable to three different heights.

It is yet another object of the present invention to provide a stepping stool which can be used advantageously for stepping exercises.

It is still another object of the present invention to provide a stepping stool which is adjustable to three different heights yet which is comprised of only two pieces.

The above and other ancillary objects are achieved by a two part or section step stool, the two sections of which can be combined or one used alone to provide a stepping stool having three alternative heights. The top section, having a predetermined height, is generally cup-shaped and can be used alone to achieve the lowest desired height. The bottom section, of generally annular configuration, has internal vertical support beams which are intentionally off center in relation to the height of the lower section. The support beams of the bottom section are configured to contact the bottom of the top section. If the bottom section is maintained in one attitude with the top section supported thereon, a second desired height is achieved for the stepping stool. If the bottom section is inverted to the opposite attitude with the top section supported thereon, a third desired height is achieved for the stepping stool.

BRIEF DESCRIPTION OF THE DRAWINGS

Other objects and advantages of the present invention will become apparent from the following detailed description of the preferred embodiment of the present invention when read in conjunction with the accompanying drawings (not drawn to scale), in which.

DETAILED DESCRIPTION OF THE PREFERRED EMBODIMENT

Figure 1:
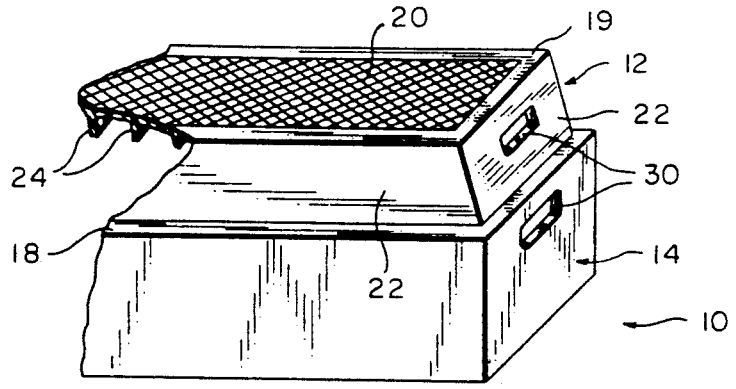
FIG. 1 is a schematic perspective partially cut away view of the two sections of the stepping stool of the present invention being used together to achieve a medium height stool in accordance with the present invention.

The preferred embodiment of the step stool 10 of the present invention is illustrated in FIG. 1 which shows the stool in a middle height form. The components of the step stool are a top section or shell 12 and a bottom spacer section 14.

The top section 12 preferably has a top feet-supporting wall 19 preferably having a slip-proof surface 20 thereon. The upper wall 19 should be large enough so that an errant foot would be unlikely to slip off the side of the top causing the user to fall. The stepping surface 20 of the top side is, for example, preferably 13 by 37 inches, although any size large enough to hold one or two feet (with shoes on) could be effectively used.

The sidewalls 22 are preferably constructed at a slight angle extending downwardly, for example at about a five degree angle. This enables easy stacking of the step stool units as well as providing a suitable lead-in for an upward moving shoe to prevent possible tripping on the corner of the step. The angled construction of the sidewalls 22 also assures that the top of the top section 12 is within the perimeter of the top or bottom of the spacer or bottom section 14 as well as within the perimeter of the bottom of the top section 12, and also facilitates molding. Having the top wall 19 within the perimeter of any possible bottom floor contacting surface also provides important stability against tipping of the combined step stool unit 10 or the top section 12 when used alone.

Below the upper wall 19 in the preferred upper section embodiment 12 are a series of downwardly descending reinforcing beams 24 provided in a criss-cross configuration similar to an "egg crate" divider. This arrangement of beams adds strength to the upper wall 19 with only a minimum of added weight. The addition of these ribs or beams provides the inside top of the upper section 12 a rectangularly corrugated appearance.

Figure 5:
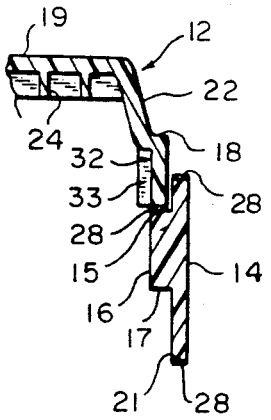
FIG. 5 is a cut away partial sectional view of the lower and upper section of the stepping stool of the present invention being used together to form a highest height stool all in accordance with the present invention.
Figure 6:
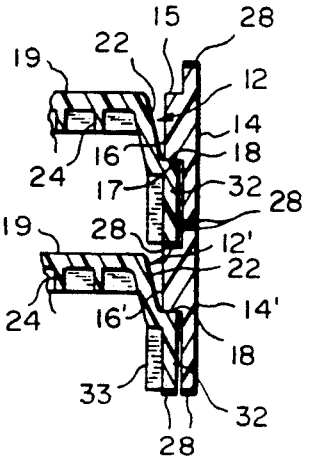
FIG. 6 is a cut away partial sectional view of two separate two-section stepping stools in stacked position, their respective lower and upper sections being in a nested relationship to minimize the overall height in stacked and nested condition for storage and shipping in accordance with the present invention.

At the juncture point of the downwardly slanted side wall 22 and a further downwardly depending sidewall portion 32 (shown in FIGS. 3–6, but hidden in FIG. 1), it is preferable that an exterior support ledge 18 be provided to permit maximum reduction of spacing when a plurality of products are nested or stacked as shown in FIG. 6. The ledge 18 is preferably located midway between the top and bottom of top section 12, and its precise location is desirably dictated by the precise construction of the bottom section 14 so as to minimize the height occupied by a plurality of units nested and stacked for shipping and/or storage as illustrated in FIG. 6.

Such downwardly depending sidewall portion 32 is further provided along the interior thereof with a plurality of horizontally spaced vertical ribs 33 which provide additional strength to the wall portion 32 while adding a minimum amount of weight. Such horizontally spaced vertically disposed ribs 33 provide the inside of the upper section 12 with a somewhat corrugated appearance. The overall height of the upper section 12 is, for example, five inches in a preferred embodiment.

Figure 2:
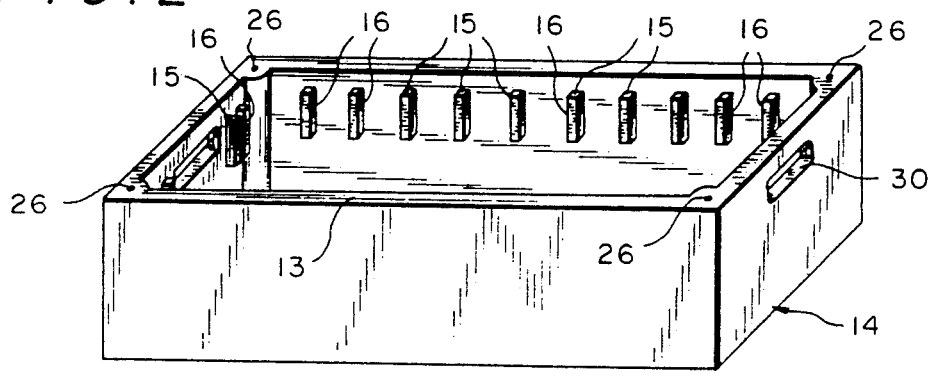
FIG. 2 is a schematic perspective view of the lower section of the stepping stool of the present invention in accordance with the present invention.

The bottom or spacer section 14 comprises a generally annular wall which, for example, is five and one-half inches tall. The bottom section 14 should have substantially straight walls, although for ease of molding a slight taper, e.g. 1°, may desirably be used. It is preferable that the thickness of the walls be held to a minimum consistent with the provision of adequate strength. Spacer ribs 16, which provide some reinforcing functions, are provided on the inner walls of the bottom section 14 primarily to provide upper and lower support ledges 15 and 17. It is an important concept of the present invention that the spacer ribs 16 be placed off center from the center point of the height of the bottom section 14. In the preferred embodiment, the top surface or upper ledge 15 of the ribs 16, as shown in FIG. 2, can be positioned relatively close to the top edge of the wall of the bottom section 14, for example, about one-half inch below the top edge 13 of the wall. The bottom surface or lower ledge 17 of the ribs 16 should be located farther away from the bottom edge 21 of the annular wall of the bottom section 14 then the top surface or upper ledge 15 of the ribs 16 is located away from the top edge 13 of the wall. For example, the lower ledge 17 of the ribs 16 can be about two and one half inches from the bottom edge 21 of the wall compared to the upper ledge 15 being one-half inch below the top edge 13 as mentioned above.

The ribs 16 should extend inwardly towards the center of the bottom section 14 such that they can fully engage and support the bottom edge of the top section 12 when the upper section 12 is put onto the bottom section 14. The ribs 16 also add strength to the walls of the bottom section 14 to prevent vertical deflection under load stress.

An added feature which can be incorporated into the corners of the bottom section 14 is to provide holes 26 at the center of the radius of the corners into each of which a soft preferably elastomer bumper 28 can be inserted into both the top and bottom surfaces of the bottom section 14. These corners can be in the form of a cylinder with bumpers, desirably in the form of buttons, at the center and the inner surface of the cylinder can be cleared by the upper top section such that the lower corners of the upper sections are concave with clearance for the cylinder in each corner.

It is preferable that any section of the step stool unit which is in contact with the floor during any of the three configurations of the present invention have the rubber bumpers 28 mentioned above to prevent slippage as well as to prevent any scuffing of either the floor or the step stool unit. Thus bumpers 28 should be placed on the bottom of the top section 12 as well as both of the top and bottom corners of the lower section 14. The bumpers 28 can be part of a system using the holes 26 as described above or the bumper system could be any prior art or future art type of bumper system. The bumpers, while of course preferable in the present invention, are not absolutely essential.

In place of bumpers in the form of buttons at the corners as disclosed above, the bumpers can take the form of a continuous soft vinyl or elastomer strip or gasket which either fits over the various floor contacting edges, or has a support portion which can be forced into a groove along these edges.

It is also preferable that handles 30 be utilized with either or both of the top section 12 and bottom section 14 to ease transportation and handling of these units. These handles can be as simple as handle holes 30 in the sides of the sections as is shown in FIGS. 1 and 2 (one side with holes shown only) or the handles could be part of any more complex handle system.

The top section 12 and the bottom section 14 of the step stool 10 according to the present invention are desirably made by molding from plastic, most preferably injection molding. Any plastic of sufficient strength can be used, such as polyvinyl chloride, polypropylene, polyethylene, impact polystyrene, ABS interpolymer, etc. Most preferably, the sections are injection molded using structural foam to reduce the weight of each unit and to reduce the shot size.

Figure 4:
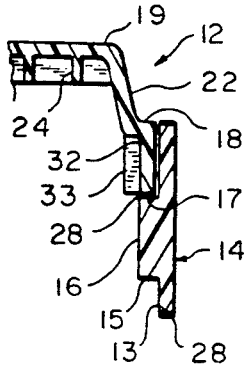
FIG. 4 is a cut away partial sectional view of the top section and the bottom section used together to achieve a middle height stepping stool in accordance with the present invention.

The stepping stool of the present invention comprising the top section 12 and the bottom section 14 provides a step stool having three different possible heights which can be alternatively used. A first lowest height stool is achieved when the top section 12 is used alone; and if the top section 12 is five inches high as in the preferred embodiment, a five inch high stool is thus available. The middle height stool is achieved when the top section 12 is placed on top of the bottom spacer section 14 as shown in FIGS. 1 and 4 while the spacer section is in an inverted position from that shown in FIG. 2. Thus, using the preferred heights described above, namely having the bottom ledges 17 of ribs 16 two and one half inches from the bottom edge 21, an eight-inch stool is available (five inch top section plus five and one-half inch bottom section minus two and one-half inches) as shown in FIG. 4. The highest height stool is achieved when the top section 12 is placed on top of the bottom spacer section 14 having the rib ledge 15 one-half inch from the top edge 13 of the wall with the bottom section 14 in an attitude as is shown in FIG. 2. The setup produces a ten inch stool (five plus five and one-half inch minus one-half inch) as shown in FIG. 5.

Figure 3:
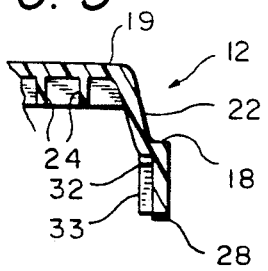
FIG. 3 is a cut away partial sectional view of the top section of the stepping stool of the present invention used alone to achieve a lowest height stool in accordance with the present invention.

In FIG. 3 the top section 12 is used alone and the height created is the lowest. In FIG. 4, the top section 12 is placed onto the lower section 14 with the bottom section 14 in the inverted position from FIG. 2. The bottom edge of the top section 12 contacts the ledges 17 of the ribs 16 of the lower section 14 to create a mid-height stool. FIG. 5 shows the highest height stool with the top section 12 again on top of the bottom section 14 with the lower section 14 in the attitude shown in FIG. 2 with the ledges 15 supporting the lower edge of the top section 12.

When the step stool is not being used, it can be stored as shown in FIG. 6, the inner ribs 16 of the bottom section 14 resting above the ledge 18 (located at the juncture of slanted downward wall 22 and upright section 32) on the top section 12. The ledge 18 is preferably situated midway (e.g. two and one-half inches) between the top and bottom of the top section 20. The wall of the bottom section 14 below the ledge 17 extends down to the horizontal surface (e.g. the floor or the top of another unit) upon which the top section rests. The ribs 16 and the preferably one-half inch above the ribs 16 wall extend upwardly and the ledge 17 rests on the ledge 18. In this configuration, the spacer assembled outside the top section is, in the preferred embodiment, five inches high and can be stacked over another assembly for storage and/or shipping, as shown in FIG. 6, which has been assembled in the same manner. Thus, each stored step stool nests into a compact assembly only five inches in height and these can be stacked one above another as shown in FIG. 6, even though each step stool can be used as a five, eight or ten-inch step. It should be noted of course, that a stool having a differently chosen three different specified heights can be provided in accordance with the present invention and such stool is intended to be within the scope of the present invention.

The step stools of the present invention are particularly well adapted for use in institutions such as health clubs and schools. In such cases, it is probable that two dozen or more units will be required. Because of the compact size and stackability of the present invention stools, relatively little space is required to store such large quantities of stools.

Thus, a stepping stool, which can be used for exercise classes or any other purpose, is achieved which can be compactly stored and which has three different positions yet only has two main pieces or sections.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or o terminology employed herein is for the purpose of description and not of limitation.

What is claimed is:

1. A step stool convertible to different heights and useful for stepping exercises, comprising:

a top section of generally inverted cup-shaped configuration having an upper wall of size sufficient to support two feet, and a sidewall depending downwardly therefrom, said sidewall terminating in a bottom edge; and a bottom section having a wall defining a generally annular configuration, said wall of said bottom section having support means for supporting the bottom edge of said top section, said support means comprising an upper ledge and a lower ledge, said upper ledge being located closer to the top of said bottom section than said lower ledge is to the bottom of said bottom section, said bottom section being adapted in a first attitude to support said top section on said upper ledge to provide a higher stepping stool, and being adapted in a second attitude to support said top section on said lower ledge to provide a shorter stepping stool.

2. A step stool according to claim 1 wherein said support means comprise a plurality of vertically disposed and horizontally spaced ribs molded off-center along the interior of said wall on said bottom section.

3. A step stool comprising an open bottom box-like top section having inner ribs, and an optionally used open top and bottom spacer section having off center with respect to the height, inner ribs wherein said ribs in said top section can correspondingly engage with said ribs in said lower section;

whereby a stool of minimum height is created when said top section is used alone, a stool of medium height is created when said top section is placed over said lower section such that said lower section is in a position with its ribs closer to the grounds such that the ribs in the top section engage with the ribs in the lower section, and a highest height stool is created when the top section engages with the lower section, the lower section having its ribs further away from the ground such that the ribs in the top section engage with those in the lower section.

4. The stool of claim 3, wherein the top section has a planar top large enough to support at least one foot wearing a shoe.

5. The stool of claim 4, wherein said top section is approximately 13 inches by 37 inches and said top section is approximately five and one-half inches high.

6. The stool of claim 3, wherein said top section and said bottom section can be nested together and multiple units can be stacked for storage purposes.

7. The stool of claim 6 wherein a ledge is provided in said top section such that when said top section and said lower section are nested together for storage, the ribs of the lower section rest on said ledge.

8. The stool of claim 3, wherein said top section has slightly angled sidewalls whereby nesting for storage as well as an increase in stability are achieved.

9. The stool of claim 3, wherein both said inner ribs in said top section and said lower spacer section constitute means for providing added strength to the stool.

10. The stool of claim 3, further comprising bumpers added to any surface which touches the floor during any configuration.

11. The stool of claim 3, wherein both said top section and said lower spacer section have handles to aid in transport of the step stool.

12. The stool of claim 3 wherein said top section and said lower spacer section are injection molded.

13. A step stool convertible to different heights and useful for stepping exercises, comprising:

a top section of generally inverted cup-shaped configuration having an upper wall means for supporting two feet, and a side wall depending downwardly therefrom, said side wall terminating in a bottom edge;

a bottom section having a wall defining a generally annular configuration, and support means for supporting said bottom edge of said side wall of said top section, said support means extending inwardly from said wall of generally annular configuration at a location such that said bottom section is adapted in a first attitude to support said top section to provide a higher stepping stool, and in a second inverted attitude to support said top section to provide a shorter stepping stool.

14. A step stool according to claim 13 wherein said support means comprises a plurality of vertically disposed and horizontally spaced ribs molded off-center along the interior of said wall on said bottom section.

15. A step stool in accordance with claim 13 wherein said top section and said bottom section are injection molded.

16. A step stool according to claim 13 wherein said support means comprises a ledge integrally molded with said generally annular wall of said bottom section.

17. A step stool according to claim 13 consisting of said top section and said bottom section, each of said top section and said bottom section being molded of a plastic material with said support means comprising a plurality of vertically disposed and horizontally spaced ribs molded off center along the interior of said wall on said bottom section, each of said top section and said bottom section being of generally rectangular configuration and having a hand-grip opening extending therethrough.

18. A step stool according to claim 13, wherein said upper wall means and said side wall of said top section merge in a rounded corner.

19. The stool of claim 18, wherein said bottom section is approximately five and one-half inches high.

20. The stool of claim 19, wherein said ribs and said bottom section have a top which is approximately one-half inch away from a top edge of the bottom section a bottom which is approximately two and one-half inches from a bottom edge of the bottom section.

* * * * *